US006308742B1

(12) United States Patent
Peulen et al.

(10) Patent No.: US 6,308,742 B1
(45) Date of Patent: Oct. 30, 2001

(54) APPARATUS AND METHOD FOR THE PREPARATION OF A LENO THREAD FOR A WEAVING MACHINE

(75) Inventors: Jaques Peulen, Rüti; Peter Uhricek, Hombrechtikon, both of (CH)

(73) Assignee: Sulzer Textil AG, Rueti (CH)

( * ) Notice: Subject to any disclaimer, the term of this patent is extended or adjusted under 35 U.S.C. 154(b) by 0 days.

(21) Appl. No.: 09/556,265

(22) Filed: Apr. 24, 2000

(30) Foreign Application Priority Data

Mar. 3, 1999 (EP) ..... 99 810 371

(51) Int. Cl.[7] ..... D03C 7/08; D03C 7/04
(52) U.S. Cl. ..... 139/54
(58) Field of Search ..... 139/48, 54, 50

(56) References Cited

U.S. PATENT DOCUMENTS

| | | | | |
|---|---|---|---|---|
| 795,353 | * | 7/1905 | Lowrie | 139/54 |
| 2,676,618 | | 4/1954 | Pfarrwaller . | |
| 5,996,646 | * | 12/1999 | Hockemeyer et al. | 139/54 |
| 6,039,086 | * | 12/1999 | Dornier et al. | 139/54 |
| 6,092,559 | * | 7/2000 | Dvorak et al. | 139/54 |

FOREIGN PATENT DOCUMENTS

| | | |
|---|---|---|
| 858976 | 12/1952 | (DE) . |
| 297 08 758 U1 | 9/1997 | (DE) . |
| 0024273A1 | 3/1981 | (EP) . |
| 1195466 | 6/1970 | (GB) . |

* cited by examiner

*Primary Examiner*—Andy Falik
(74) *Attorney, Agent, or Firm*—Townsend and Townsend and Crew LLP

(57) ABSTRACT

The apparatus (1) for the preparation of at least two leno warp threads (6*a*, 7*a*) for a weaving machine (13; 17) comprises a first holder apparatus (7*b*) for the reception of a first leno thread bobbin (7) as well as a second holder apparatus (6*b*) for the reception of a second leno thread bobbin (6) as well as a rotatably journalled thread guide apparatus (3) which supplies the leno warp threads (6*a*, 7*a*) to a weaving machine (13; 17) which is placed after it in the direction of thread travel (F), with the first holder apparatus (7*b*) being arranged first in the direction of thread travel (F), being followed by the second holder apparatus (6*b*), and being then followed by the thread guide apparatus (3), and with a thread guide element (2*m*) for the guiding of the first leno warp thread (7*a*), which is to be drawn off from the first warp thread bobbin (7), being arranged substantially in the direction of thread travel (F) and extending adjacent to the second holder apparatus (6*b*), with the thread guide element (2*m*) having an entry opening (2*z*) for the first leno warp thread (7*a*) which is arranged ahead of the second holder apparatus (6*b*) in the direction of thread travel (F), and with the thread guide element (2*m*) being designed to extend in such a manner and is rotatable through 360° and drivably journalled about an axis of rotation which extends substantially in the direction of thread travel (F) in such a manner that the second warp thread bobbin (6), which is arrangeable on the second holder apparatus (6*b*), can be circled by the thread guide element (2*m*) in order to twist the first leno warp thread (6*a*), which emerges from the thread guide element (2*m*), together with the second leno warp thread (7*a*), which extends between the second warp thread bobbin (6) and the thread guide apparatus (3).

13 Claims, 6 Drawing Sheets

13b
12
13
15
13a
13g
13a
13a
13d
15
12
18
11c
11b
11a
13c
13e
13f
7a
5
3
13a
13a
6a
7a
6a
F
5
3
F
2
6a
6
14d
14e
6a
2
6
4
2x
7a
4
2x
7a
7
7
14a
14b
14c
14

1
2
3
3e
5
6
6a
7
7a
11a
11b
11c
11d
12
17
17a
17b
F

APPARATUS AND METHOD FOR THE PREPARATION OF A LENO THREAD FOR A WEAVING MACHINE

BACKGROUND OF THE INVENTION

1. Field of the Invention

The invention further relates to a method for the preparation of a leno thread for a weaving; machine in accordance with the preamble of claim 8.

2. Description of the Prior Art

A leno thread delivery apparatus for a weaving machine is known from the document EP 0 024 273 which has a complicated and expensive apparatus prone to wear in order to produce two mutually twisted or rotated leno threads respectively through a rotation of leno thread bobbins.

SUMMARY OF THE INVENTION

The object of the present invention is to propose an economically more advantageous apparatus for the preparation of a leno thread.

This object is satisfied in particular by an apparatus for the preparation of at least two leno warp threads for a weaving machine, comprising a first holder apparatus for the reception of a first leno thread bobbin, also called the first warp thread bobbin in the following, as well as comprising a second holder apparatus for the reception of a second leno thread bobbin, also called the second warp thread bobbin, as well as comprising a rotatably journalled thread guide apparatus which supplies the leno warp threads to a weaving machine which is placed after it in the direction of thread travel, with the first holder apparatus being arranged first in the direction of thread travel, followed by the second holder apparatus, then being followed by the thread guide apparatus, with a thread guide element for the guiding of the first leno warp thread, which is to be drawn off from the first warp thread bobbin, being arranged substantially in the direction of thread travel and extending adjacent to the second holder apparatus, and with the thread guide element having an entry opening for the first leno warp thread which is arranged ahead of the second holder apparatus in the direction of thread travel, and with the thread guide element being designed to extend in such a manner and is rotatable through 360° and drivably journalled about an axis of rotation which extends substantially in the direction of thread travel in such a manner that the second warp thread bobbin, which can be arranged on the second holder apparatus, can be circled by the thread guide element in order to twist the first leno warp thread, which emerges from the thread guide element, with the second leno warp thread, which extends between the second warp thread bobbin and the thread guide apparatus.

The apparatus in accordance with the invention has the advantage that the holder apparatuses for the warp thread bobbins, and thus naturally also the warp thread bobbins themselves, are arranged in a fixed, i.e. stationary, manner. The apparatus in accordance with the invention has only a small number of moving parts, for which reason it is very economical to manufacture and in addition ensures a reliable and economical operation. A particular advantage of the apparatus in accordance with the invention and of the method in accordance with the invention respectively is to be seen in that the possibility also exists of mutually winding the leno warp threads around each other with a high speed of rotation, which is of central importance for a high performance weaving machine such as a series shed weaving machine, since the high weaving performance requires a correspondingly rapid preparation of the leno warp threads. A further advantage is to be seen in that the leno warp threads are continually mutually twisted rotating in the same direction, which has the advantage that a time consuming change of the direction of rotation during the twisting is no longer required.

The apparatus in accordance with the invention comprises a thread guide apparatus which is intended to supply the thread in a manner which is synchronised with respect to the working process of the weaving machine, in order to hold the leno warp threads in the position required for the weft insertion while forming a shed. The apparatus in accordance with the invention has the advantage that the distance between the thread guide apparatus and the apparatus which rotates the leno warp threads, also designated as a pre-rotation apparatus, can be chosen as desired so that the thread guide apparatus can for example be arranged in the vicinity of the weaving machine or forming a part of the weaving machine, whereas the pre-rotation apparatus can be arranged at a different location.

BRIEF DESCRIPTION OF THE DRAWINGS

The invention will be described with reference to a plurality of exemplary embodiments. Shown are.

DETAILED DESCRIPTION OF THE PREFERRED EXEMPLARY EMBODIMENTS

In the following exemplary embodiments the same objects are designated with the same reference symbols.

Figures 1A, 1B, 1C:
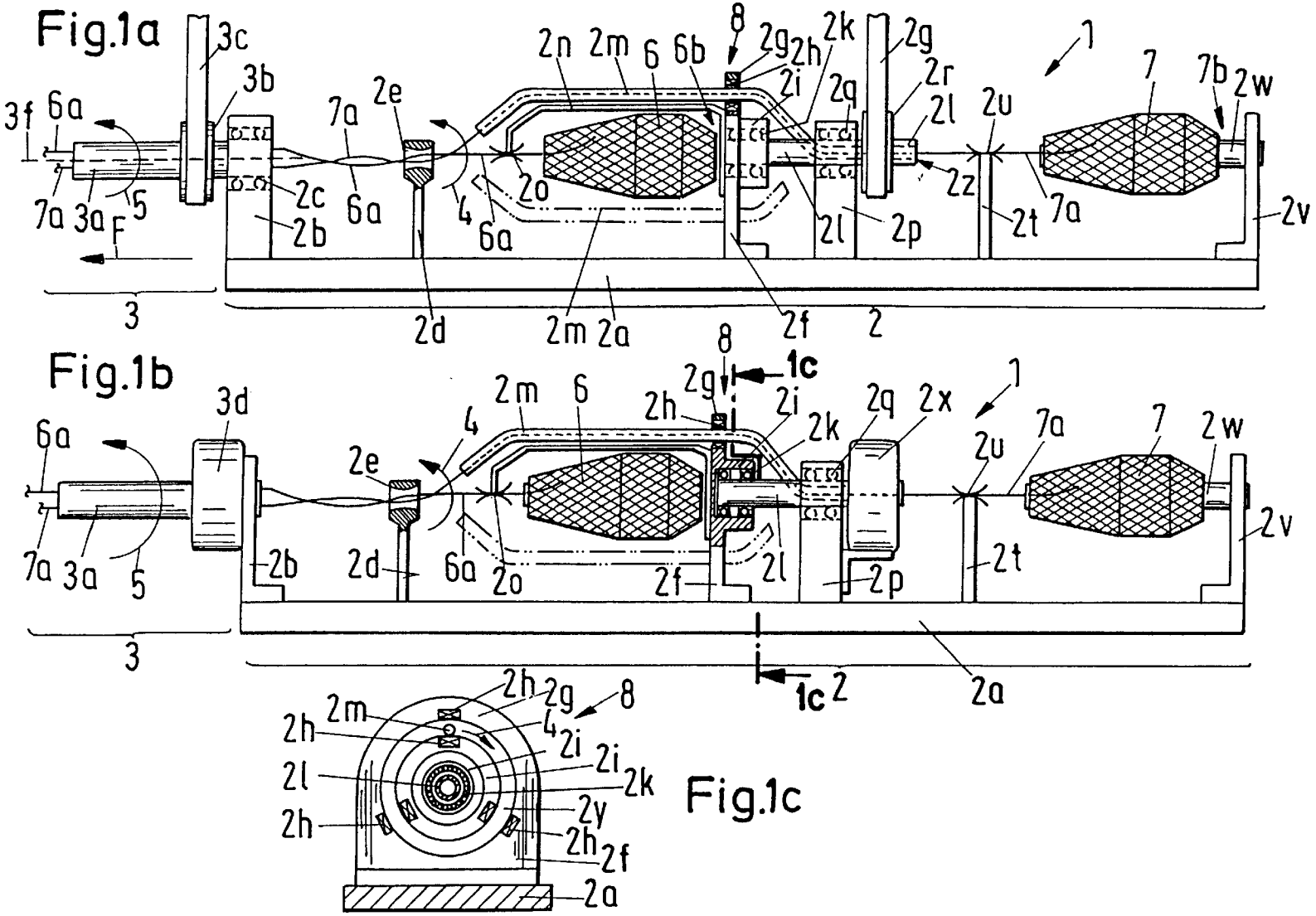
FIG. 1*a* is a side view of the apparatus for the preparation of leno warp threads; is
FIG. 1*b* is a side view of a further embodiment of the apparatus for the preparation of leno warp threads; is
FIG. 1*c* is a sectional view along the line A—A in accordance with FIG. 1*b;*

The apparatus 1 for the preparation of leno warp threads 6*a*, 7*a* which is illustrated in FIG. 1*a* comprises a pre-rotation apparatus 2 and a thread turning apparatus 3 which is arranged after it in the direction of thread travel F. The pre-rotation apparatus 2 comprises a base plate 2*a* to which the holder means 2*b*, 2*d*, 2*f*, 2*p*, 2*t* and 2*v* are firmly connected. The holder means 2*v* forms together with the mandrel 2*w*, which extends in the horizontal direction, a first holder apparatus 7*b* for a warp thread bobbin 7. Arranged after the holder apparatus 7*b* in the direction of thread travel F is a thread brake 2*u* which is firmly connected to the holder means 2*t* and which serves for the braking of the leno warp thread 7*a*. Arranged after the thread brake 2*u* in the direction of thread travel F is a second holder apparatus 6*b* for the reception of a second warp thread bobbin 6, with the mandrel which extends in the horizontal direction for the reception of the warp thread bobbin 6 not being visibly illustrated. Arranged after the warp thread bobbin 6 is a thread brake 2*o* which brakes the leno warp thread 6*a*, with the second holder apparatus 6*b* and the thread brake 2*o* being firmly connected to a support part 2*i* and being held at the holder means 2*p* via the bearing point 2*k*, the shaft 21 and the bearing point 2*q*. A rotatable thread guide element 2*m* is journalled so as to be rotatable by 360° about an axis of rotation which extends in the direction of thread travel F in the exemplary embodiment illustrated, with the thread guide element 2*m* being designed and arranged in such a manner that it circles the second warp thread bobbin 6. The shaft 21 is arranged to be aligned in the axial direction with the mandrel of the second warp thread bobbin 6, which extends in the horizontal direction, with the thread guide element 2*m* being firmly connected to the shaft 21 and being rotatably journalled via the bearing point 2*q*. The thread guide element 2*m* is concentrically movably journalled about an axis which is defined by the longitudinal axis of the mandrel, i.e. of the second warp thread bobbin 6 which is arranged thereon, with a drive apparatus 2*x*; 2*s*, 2*r* being provided which continuously rotates the shaft 21 and the thread guide element 2*m* in the direction of rotation 4. The entry opening 2*z* of the thread guide element 2*m* facing the first warp thread bobbin 7 is arranged ahead of the second holder apparatus 6*b* in the direction of thread travel F. The first leno warp thread 7*a* enters into this opening 2*z*, is conducted outwardly around the second warp thread bobbin 6 by the thread guide element 2*m* and is rotated between the second warp thread bobbin 6 and the thread turning apparatus 3 about the second leno warp thread 6*a*, which extends between them, so that the two leno warp threads 6*a*, 7*a* are mutually twisted together. Arranged after the second holder apparatus 6*b* is an eye 2*e* which is firmly connected to the holder means 2*d*, with a ball bearing 2*c* which is held by the holder means 2*b* being arranged afterwards in which the thread turning apparatus 3 is journalled so as to be rotatable in the direction 5. The thread turning apparatus 3 comprises two bores 3*g* which extend inside the guide tube 3*a* parallel to the axis of rotation 3*f* and in each of which a leno warp thread 6*a*, 7*a* is guided. The guide tube 3*a* is connected via a transmission 3*b*, 3*c* to a non-illustrated drive in order to rotate the guide tube 3*a* in the direction of rotation 5.

Figure 1D:
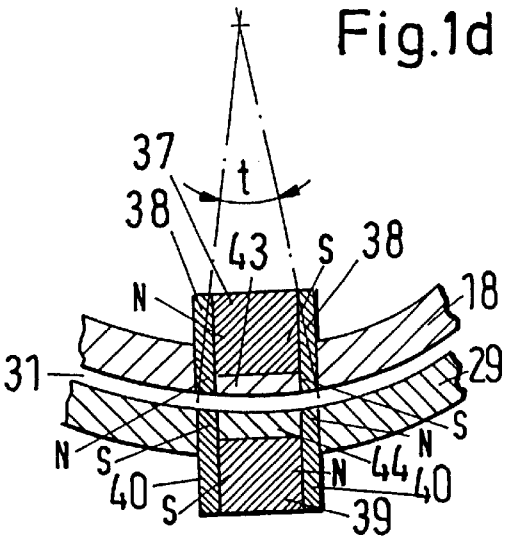
FIG. 1*d* is a detail view of a holder apparatus.

FIG. 1*b* shows a further exemplary embodiment of the apparatus 1 in accordance with the invention, with, in contrast to the embodiment in accordance with FIG. 1*a*, each transmission 3*b*, 3*c*; 2*r*, 2*s* being replaced by an electric motor 3*d*, 2*x*, with the electric motors 3*d*, 2*x* being firmly connected to the holder means 2*b*, 2*p* and rotatingly driving the guide tube 3*a* and the shaft 21 respectively in the direction 5, 4. Otherwise the exemplary embodiments in accordance with FIG. 1*a* and FIG. 1*b* are identically designed. These two embodiments comprise a holder apparatus 8 of which the design will be explained in detail with reference to FIG. 1*c*, a side view along the line A—A in accordance with FIG. 1*b*. The holder apparatus 8 comprises a holder means 2*f* which is firmly connected to the base plate 2*a* and which, as can be seen in FIG. 1*c*, has a circular aperture. A support part 2*i* comprises a circular part which is arranged concentrically with respect to said circular aperture and which has a smaller diameter so that a concentrically arranged gap 2*y* which extends over 360° is formed between the holder means 2*f* and the support part 2*i*. The thread guide element 2*m* extends in the view in accordance with FIG. 1*c* perpendicular to the plane of view and through the gap 2*y* and is journalled so as to be rotatable by 360° in the direction of rotation 4. The support part 2*i* is, as can be seen in FIG. 1*b*. rotatably journalled via the ball bearing 2*k* at the shaft 21, with the shaft 21 in addition being firmly arranged and rotatably journalled via the ball bearing 2*q* and the holder means 2*p*. Arranged in opposite positions at the holder means 2*f* and at the support part 2*i* are permanent magnets 2*h*. which prevent a rotation of the support part 2*i* relative to the holder means 2*f*. The support part 2*i* per se is held via the ball bearing 2*k* so as to be freely rotatable in the direction 4, with the permanent magnets 2*h* preventing the rotation of the support part 2*i*. A detail of an arrangement of permanent magnets of this kind is shown in FIG. 1*d*. The fixedly arranged part 29 comprises a permanent magnet 39, at both sides of which pole shoes 40 are arranged, which open in the direction towards the inner surface of the part 29. The part 18, which is rotatably journalled about the centre of rotation, likewise comprises a permanent magnet 37 with pole shoes 38 which are arranged at both sides and which are arranged in part 18 so as to open in the direction towards part 29. Since the permanent magnets 37, 39 are arranged with opposite polarisations and the pole shoes 38, 40 are arranged to lie oppositely, a force arises which counteracts a rotation of the part 18 in the direction of rotation so that part 18 is held by magnetically acting forces with respect to a rotation. Magnets of this kind are arranged in the holder apparatus 8 in accordance with FIGS. 1*a* and 1*b* so that the second holder apparatus 6*b* and the holder part 2*n* with the thread brake 2*o*, although rotatably journalled via the bearing point 2*k* per se, are held firmly in the illustrated position.

Figure 2A:
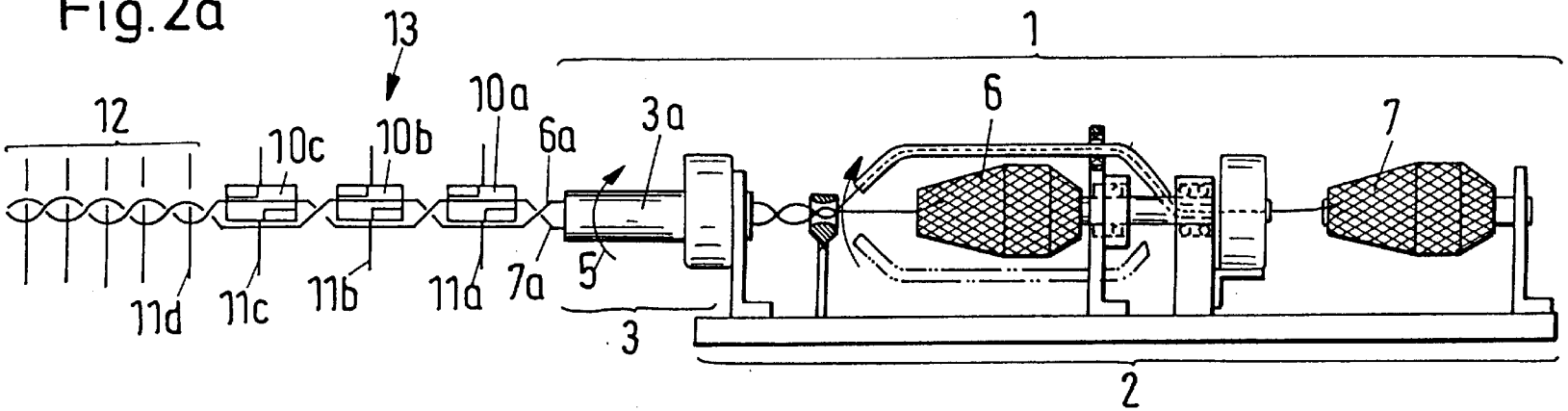
FIG. 2*a* illustrate the apparatus for the preparation of leno warp threads with a series shed weaving machine placed after it.
Figure 2B:
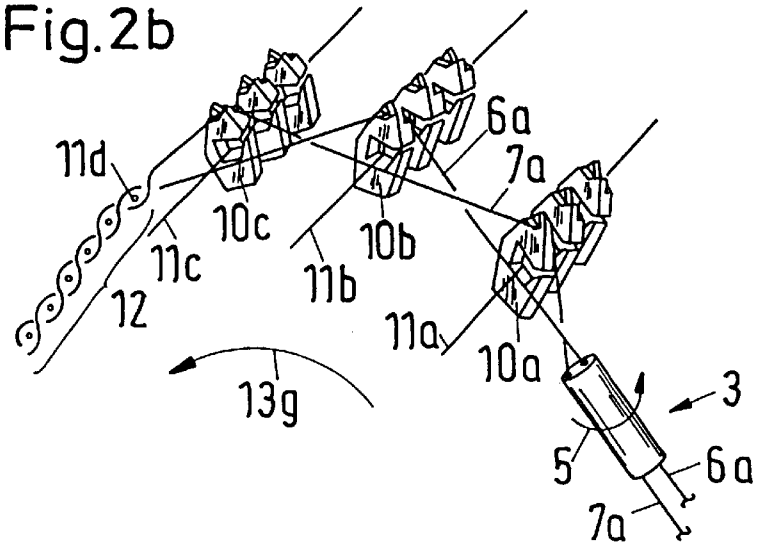
FIG. 2*b* is a detail view of the series shed weaving machine in accordance with FIG. 2*a;*

FIG. 2*a* shows the apparatus 1 in accordance with the invention, after which a series shed weaving machine 13 is placed in the direction of thread travel F. The weaving rotor has shed holder elements 10*a*, 10*b*, 10*c* at its surface which are arranged with spacing in the direction of rotation 13*g* and into the upper and lower sheds of which the leno warp threads 6*a*, 7*a* are inserted. In this the thread turning apparatus 3 is rotated in the direction of rotation 13*g* in a manner which is synchronised with the movement of the weaving rotor such that, and the thread turning apparatus 3 is arranged with respect to the shed holder elements 10*a*, 10*b*, 10*c* in the region of the weaving rotor in a manner such that the leno warp threads 6*a*, 7*a* are alternatingly inserted into an upper and a lower shed, as illustrated in FIG. 2*a*. The weft thread 11*a*, 11*b*, 11*c* is inserted into the shed holder elements 10*a*, 10*b*, 10*c* so that a cloth part 12 with a leno weave results after a completed weft thread insertion 11*d*. FIG. 2*b* shows the arrangement illustrated in FIG. 2*a* once again in a perspective illustration.

Figure 3:
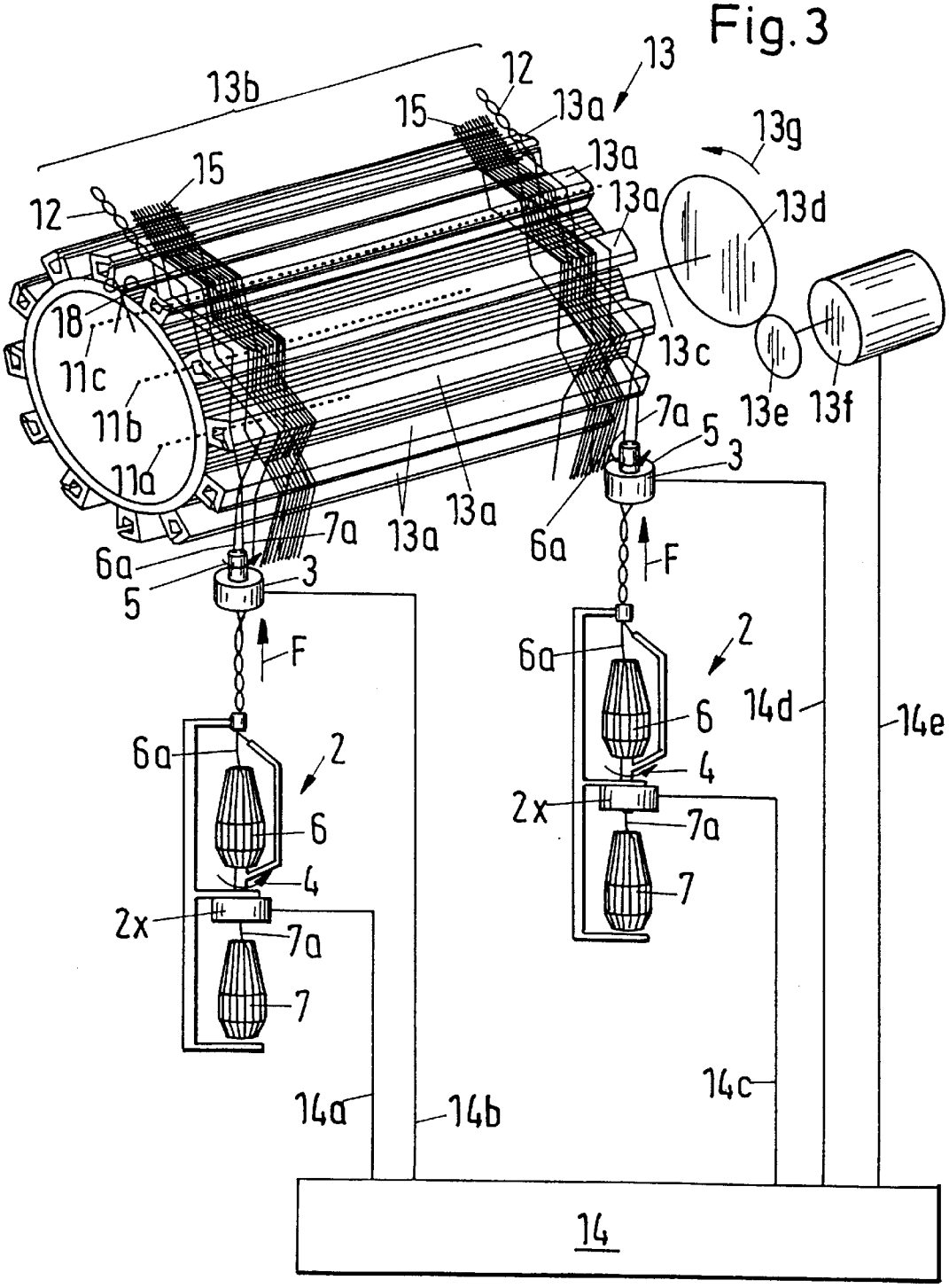
FIGS. 3, 4 illustrate a plurality of apparatuses for the preparation of leno warp threads in combination with a series shed weaving machine placed after them.

FIG. 3 shows a further series shed weaving machine 13 comprising a weaving rotor 13*b* with insertion passages 13*a* which are arranged with spacing in the direction of rotation 13*g* at its surface, which are formed by shed holder elements 10*a*, 10*b*, 10*c*, and into which the weft threads 11*a*, 11*b*, 11*c* are inserted. One pre-rotation apparatus 2 is arranged on each side of the weaving rotor with a thread turning apparatus 3 placed after it in the direction of thread travel F, which insert the leno warp threads 6*a*, 7*a* into the shed holder elements 10*a*, 10*b*, 10*c* in such a manner that an insertion shed for the weft threads 11*a*, 11*b*, 11*c* arises.

The weft threads 11*a*, 11*b*, 11*c* are severed at the insertion side with a thread shear 18. The cloth 15 which is produced has at the edge in each case a cloth part 12 with a leno weave. The axis of rotation 13*c* of the weaving rotor 13*b* is driven via a transmission 13*d*, 13*e* by an electric motor 13*f*.

A regulation apparatus 14 controls via electrical lines 14*a*, 14*b*, 14*c*, 14*d*, 14*e* the drive apparatus 2*x*, the thread turning apparatus 3 and the electric motor 13*f* in such a mutually synchronised manner that the leno warp threads 6*a*, 7*a* are successively inserted into upper and lower sheds of the shed holder elements 110*a*, 10*b*, 10*c* which are intended for this purpose. A sensor which measures the position of the weaving rotor 13*b* in order to control the speed of rotation of the drive apparatus 2*x* and of the thread turning apparatus 3 with the help of this signal could also be arranged at the electrical line 14*e*. The drive apparatus 2*x* and the thread turning apparatus 3 are preferably controlled in such a manner that that they rotate with approximately the same angular velocity in the direction of rotation 4, 5 so that the supply of twisted leno warp threads 6*a*, 7*a* which is present between the thread turning apparatus 3 and the pre-rotation apparatus 2 remains constant. The distance between the thread turning apparatus 3 and the pre-rotation apparatus 2 can be chosen as large as desired. The thread turning apparatus 3 is to be arranged with respect to the weaving rotor 13*b* in such a manner that the leno warp threads 6*a*, 7*a* are reliably inserted by the former into the shed holder elements 10*a*, 10*b*, 10*c*. The section of twisted leno warp threads 6*a*, 7*a* which is located between the thread turning apparatus 3 and the pre-rotation apparatus 2 could also be led around deflection points. In principle the thread turning apparatus 3, as well as the first holder apparatus 7*b* with the warp thread bobbin 7, as well as the second holder apparatus 6*b* with the warp thread bobbin 6 could be arranged at any desired locations as long as the leno warp threads 6*a*, 7*a* are guided from the one apparatus 7*b*, 6*b*, 3 to the next. Thus it is necessary only that these apparatuses 7*b*, 6*b*, 3 are arranged to follow one another in the direction of thread travel F, with it also being possible for the apparatuses 7*b*, 6*b*, 3 to be locally distributedly arranged for example adjacently or at different locations, so that it is not necessary to arrange these apparatuses 7*b*, 6*b*, 3 successively on a line as illustrated. The leno warp threads 6*a*, 7*a* could be led individually or pair-wise via deflection points so that their direction of thread travel F has deflections, with the apparatuses 7*b*, 6*b*, 3 also being arranged in this arrangement to follow one another with respect to the leno warp thread 6*a*, 7*a*, which moves along the direction of thread travel F. It is advantageous for the leno shed formation if the thread turning apparatus 3 is arranged near the shed holder elements of the series shed weaving machine which rotate past in order to be able to insert the leno warp threads 6*a*, 7*a* into the weaving rotor in the respective upper or lower shed. During the weaving of separate cloth webs the apparatuses described could also be arranged within the web in order to weave so-called separation strips with the leno warp threads 6*a*, 7*a*.

Figure 4:
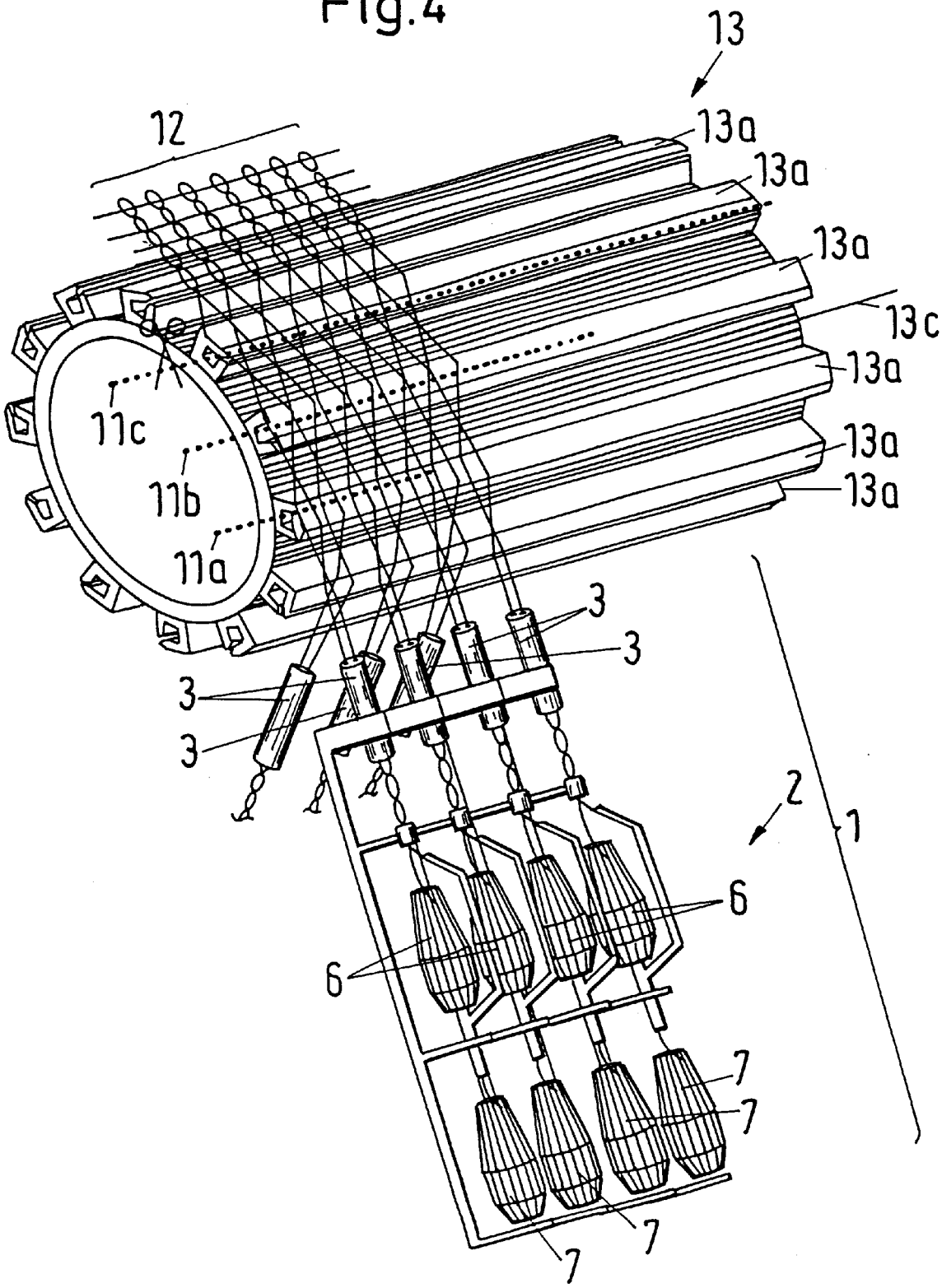
Figures 5A, 5B:
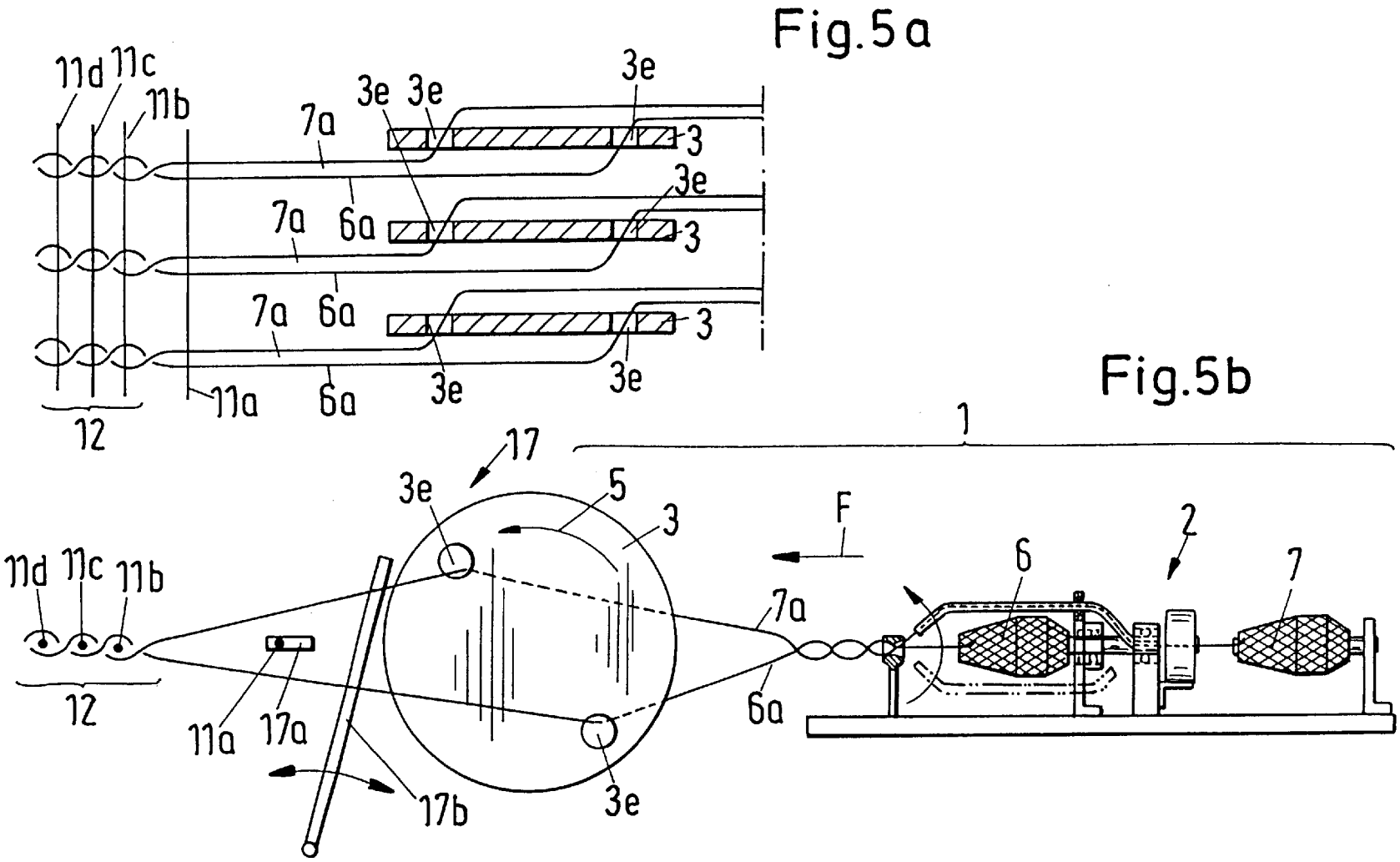
FIG. 5*a* is a plan view of rotatably journalled thread guide apparatuses in a heald loom.
FIG. 5*b* illustrate the apparatus for the preparation of leno warp threads with a heald loom which is placed after it.

FIG. 4 shows a plurality of apparatuses 1 in accordance with the invention which supply leno warp threads 6*a*, 7*a* to a series shed weaving machine 13. The cloth part 12 having the leno weave can be manufactured with any desired width through a corresponding number of apparatuses 1, with it also being possible for the cloth 15 to be manufactured only of leno weaves over its entire width as a so-called leno cloth. In FIG. 3 the thread turning apparatus 3 and the rotatable thread guide element 2*m* are driven so as to rotate to the right in the direction 4, 5. The thread turning apparatus 3 and the rotatable thread guide element 2*m* could however also be driven so as to rotate in the opposite direction, or in such a manner that the direction of rotation is changed after specific, predeterminable time intervals. In addition the thread turning apparatus 3 and/or the thread guide element 2*m* could stand still for a specific time interval. The apparatus 1 in accordance with the invention enables, depending on the respective direction of rotation of the thread guide element 2*m* or of the thread turning apparatus 3 which is predeterminable through the control and regulation apparatus 14, a large number of different weave kinds to be manufactured, in addition to the basic weave kinds such as half leno, full leno or twine leno, as well as variations in which for example the direction of rotation and/or the basic weave kind is changed after certain time intervals for the same pair of leno warp threads 6*a*, 7*a*. In addition, further variations are possible in which, through a corresponding control of the thread turning apparatus 3, for example only every other or every third weft thread 11*a*, 11*b*, 11*c* is tied off. Likewise the pair of leno warp threads 6*a*, 7*a* could have a rotation of more than 180 degrees between two successively arranged weft threads 11*a*, 11*b*, which means a rotation by an integral multiple of 180 degrees, for example a rotation of 360 degrees. Thus cloths 15 with the most diverse, varying weaves can be manufactured, which can for example be used for the manufacture of special weave patterns. This variety of weave possibilities allows cloths to be manufactured that were previously unknown. Therefore it can also be determined whether a cloth has been manufactured in accordance with the method in accordance with the invention. FIG. 5*b* shows the apparatus 1 in accordance with the invention with a heald loom 17 which is arranged after it in the direction of thread travel F. The thread turning apparatus 3 is executed as a disc which can be rotated in the direction 5 and which has two oppositely disposed holes 3*e*, with a leno warp thread 6*a*, 7*a* being passed through each hole 3*e*. The thread turning apparatus 3 controls the position of the two leno warp threads 6*a*, 7*a* so that the latter form an open shed into which a weft thread 11*a* can be inserted using an insertion means 17*a* and is beat up at the cloth edge by a reed 17*b* so that a cloth 12 forms. FIG. 5*a* shows a plan view of the apparatus in accordance with FIG. 5*b*, with three apparatuses 1 in accordance with the invention being arranged to extend parallel and adjacently so that three pairs of leno warp threads 6*a*, 7*a* can be supplied, which are woven to form a cloth through the insertion of weft threads 11*a*, 11*b*, 11*c*.

Figure 6:
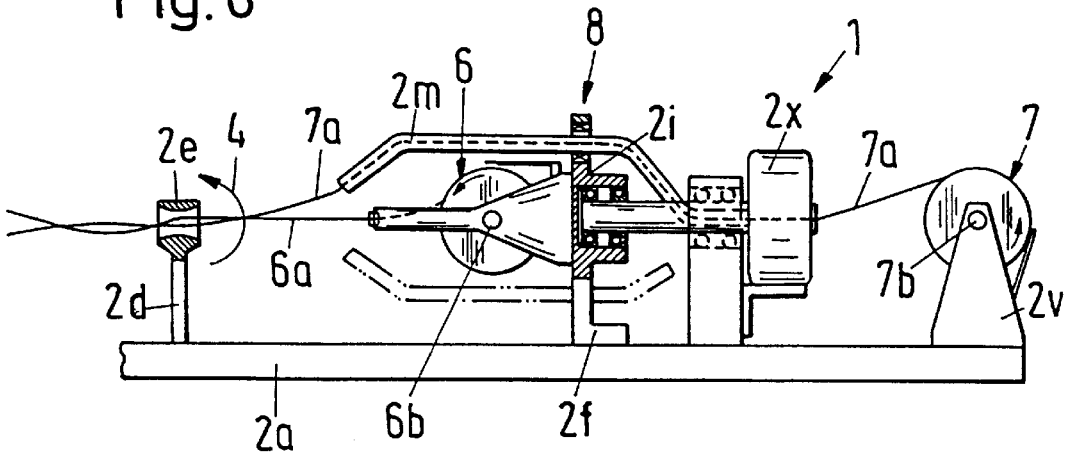
FIG. 6 illustrates a further embodiment of the apparatus for the preparation of leno warp threads.

The exemplary embodiment of an apparatus 1 for the preparation of leno warp threads 6*a*, 7*a* which is illustrated in FIG. 6 has, in contrast to the embodiment in accordance with FIG. 1*b*, warp thread bobbins 6, 7 which are arranged to extend perpendicular to the plane of the drawing and which are held by the holder apparatuses 6*b*, 7*b* so as to be rotatable in the arrow direction. Otherwise this apparatus 1 is designed the same as that illustrated in FIG. 1*b*.

In a further, non-illustrated exemplary embodiment the warp thread bobbin 7 which is arranged at the apparatus 1 could be dispensed with in that the leno warp thread 7*a* is taken off directly from the warp beam of the weaving machine.

Figure 7:
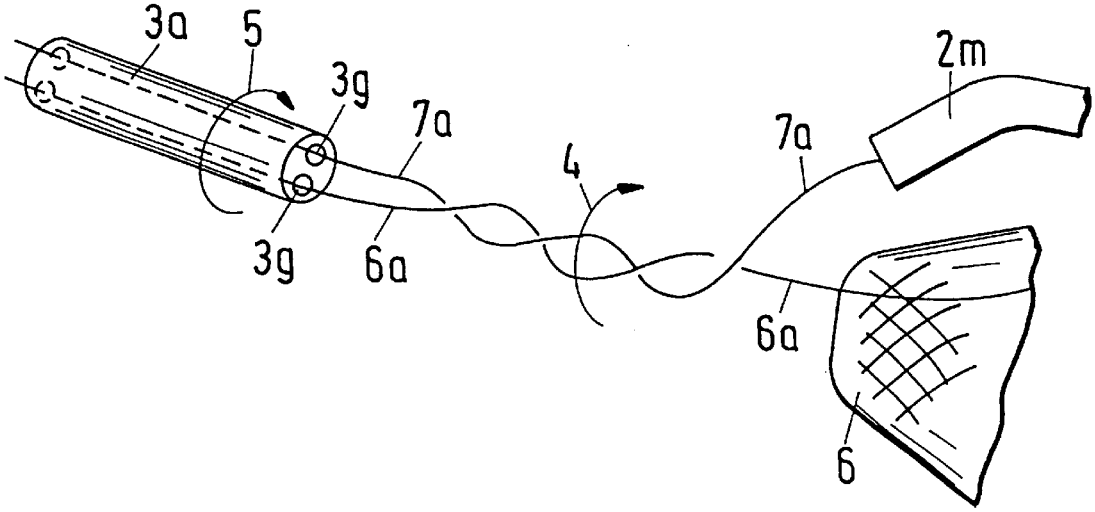
FIG. 7 is a detail view of the thread turning apparatus.

FIG. 7 shows the twisting of the two leno warp threads 6*a*, 7*a* in detail, with the latter being mutually twisted through the thread guide element 2*m* which rotates in the direction 4. The guide tube 3*a*, through the bores 3*g* of which the two leno warp threads 6*a*, 7*a* pass, is rotated in the direction of rotation 5. This rotating in the direction 5 effects an untwisting of the twisted leno warp threads 6*a*, 7*a* which are located between the guide tube 3*a* and the warp thread bobbin 6. Thus a supply of twisted leno warp threads 6*a*, 7*a* can be intermediately stored between the guide tube 3*a* and the warp thread bobbin 6, with it being possible to determine the total number of the windings by a corresponding rotation of the guide tube 3*a* and/or of the thread guide element 2*m*.

What is claimed is:

1. Apparatus for the preparation of at least two leno warp threads for a weaving machine, the apparatus comprising a first holder apparatus arranged in a fixed position for the reception of a first leno warp thread bobbin; a second holder apparatus arranged in a fixed position for the reception of a second leno warp thread bobbin; a rotatably journalled leno warp thread guide apparatus for supplying the leno warp threads to a weaving machine that is placed downstream from the leno warp thread guide apparatus in a direction of leno warp thread travel; wherein the first holder apparatus is arranged first in the direction of leno warp thread travel, followed by the second holder apparatus, and then followed by the thread guide apparatus; wherein a leno warp thread guide element for the guiding of a first leno warp thread that is to be drawn off from the first leno warp thread bobbin is arranged substantially in the direction of leno warp thread travel and extends adjacent to the second holder apparatus; wherein the leno warp thread guide element has an entry opening for the first leno warp thread and is arranged ahead of the second holder apparatus in the direction of leno warp thread travel; and wherein the thread guide element is rotable through 360° about the second leno warp thread bobbin and drivably journalled about an axis of rotation that extends substantially in the direction of leno warp thread travel in such a manner that the second leno warp thread bobbin can be circled by the leno warp thread guide element in order to twist the first leno warp thread that emerges from the leno warp thread guide element with a second leno warp thread that extends between the second leno warp thread bobbin and the leno warp thread guide apparatus.

2. Apparatus in accordance with claim 1 wherein a leno warp thread brake is arranged after at least one of the first and the second holder apparatuses in the direction of leno warp thread travel.

3. Apparatus in accordance with claim 1 wherein the leno warp thread guide apparatus is designed as a part that extends substantially in the direction of leno warp thread travel and the leno warp thread guide apparatus' axis of rotation extends substantially parallel to the direction of leno warp thread travel.

4. Apparatus in accordance with claim 3 wherein the leno warp thread guide apparatus has two apertures that are arranged spaced apart and that extend substantially parallel to the axis of rotation, with each aperture being intended for the reception of a leno warp thread.

5. Apparatus in accordance with claim 1 wherein the leno warp thread guide apparatus is designed in disc shape and has two diametrically arranged apertures, each for the reception of a respective leno warp thread.

6. Apparatus in accordance with claim 1 wherein the leno warp thread guide element is arranged at a rotatable shaft, wherein the rotatable shaft is rotatably journalled at an end section at a bearing point and is connected to a drive apparatus, wherein the rotatable shaft has a bearing point at an opposite end section that is firmly connected to a support part and to the second holder apparatus, wherein a holder means that extends perpendicularly to the rotatable shaft is arranged at the support part, wherein the support part and the holder means are designed and arranged mutually matched in such a manner that a ring-shaped gap is formed between the support part and the holder means, wherein at least one magnet is arranged at each of the holder means and the support part oppositely disposed with respect to the gap in order to prevent a mutual rotation of the support part with respect to the holder means, and wherein the leno warp thread guide element extends through the gap and is rotatable 360° in a direction of extent of the gap.

7. Apparatus in accordance with claim 1 wherein the leno warp thread guide apparatus and the leno warp thread guide element are drivable by a drive apparatus, wherein the drive apparatus is connected to a regulation apparatus, and wherein the regulation apparatus controls the speed of rotation of the leno warp thread guide apparatus and of the leno warp thread guide element in such a manner that the latter has a synchronous speed of rotation with the former.

8. A method for the preparation of at least two leno warp threads for a weaving machine, the method comprising drawing off a respective leno warp thread from at least two leno warp thread bobbins and winding these leno warp threads mutually about one another, arranging the first leno warp thread bobbin in a first fixed positioned holder apparatus first in a direction of thread travel, arranging the second leno warp thread bobbin in a second fixedly positioned holder apparatus after the first leno warp thread bobbin in the direction of said travel, arranging a thread guide apparatus after the second leno warp thread bobbin in the direction of said travel, drawing off the first leno warp thread from the first leno warp thread bobbin, circling the first leno warp thread around the second leno warp thread bobbin and guiding the first leno warp thread with a thread guide element in a manner such that the first leno warp thread is laid around the second leno warp thread that is drawn off from the second leno warp thread bobbin, and rotating the two leno warp threads by the thread guide apparatus in such a manner that the two leno warp threads are supplied to the weaving machine in a manner that is synchronized with respect to a weaving process.

9. A method in accordance with claim 8 wherein the speed of rotation of the thread guide element and the thread guide apparatus aresynchronous to each other.

10. A method in accordance with claim 8 wherein the pair of leno warp threads are supplied to the weaving machine rotating the thread guide apparatus to the left or to the right.

11. A method in accordance with claim 8 wherein the direction of rotation of the pair of leno warp threads is changed, and wherein the pair of leno warp threads might be held with out executing a rotation during a predeterminable period of time.

12. A method in accordance with claim 8 wherein a plurality of pairs of leno warp threads are supplied to the weaving machine, with at least one of the direction of rotation and the speed of rotation of the individual pairs of leno warp threads being predeterminable independently of one another.

13. A weaving machine comprising apparatus for the preparation of at least two leno warp threads for a weaving machine, the apparatus comprising a first holder apparatus arranged in a fixed position for the reception of a first leno warp thread bobbin; a second holder apparatus arranged in a fixed position for the reception of a second leno warp thread bobbin; a rotatably journalled leno warp thread guide apparatus for supplying the leno warp threads to the weaving machine that is placed downstream from the leno warp thread guide apparatus in a direction of leno warp thread travel; wherein the first holder apparatus is arranged first in the direction of leno warp thread travel, followed by the second holder apparatus, and then followed by the leno warp thread guide apparatus; wherein a thread guide element for the guiding of a first leno warp thread that is to be drawn off from the first warp thread bobbin is arranged substantially in the direction of thread travel and extends adjacent to the second holder apparatus; wherein the thread guide element has an entry opening for the first leno warp thread and is arranged ahead of the second holder apparatus in the direction of thread travel; and wherein the thread guide element is rotable through 360° about the second leno warp thread bobbin and drivably journalled about an axis of rotation that extends substantially in the direction of thread travel in such a manner that the second warp thread bobbin can be circled by the thread guide element in order to twist the first leno warp thread that emerges from the thread guide element with a second leno warp thread that extends between the second warp thread bobbin and the thread guide apparatus.

* * * * *